United States Patent [19]

Strohbeen

[11] Patent Number: 4,590,333

[45] Date of Patent: May 20, 1986

[54] MULTIDRIVER LOUDSPEAKER

[76] Inventor: John Strohbeen, 160 Bergen St., Brooklyn, N.Y. 11217

[21] Appl. No.: 620,419

[22] Filed: Jun. 14, 1984

[51] Int. Cl.[4] ..... H04R 1/24; H04R 19/00

[52] U.S. Cl. ..... 179/115.5 PS; 179/115.5 R; 179/115.5 VC; 179/116; 181/144

[58] Field of Search ..... 179/115.5 PS, 115.5 R, 179/115.5 VC, 115.5 PV, 115.5 ES, 115.5 DV, 116; 181/144, 163; 381/86

[56] References Cited

U.S. PATENT DOCUMENTS

| | | | |
|---|---|---|---|
| 2,091,011 | 8/1937 | Phelps et al. | 179/115.5 R |
| 2,512,323 | 7/1950 | Gersch | 181/157 |
| 2,538,621 | 1/1951 | Hopkins et al. | 179/115.5 VC |
| 2,755,343 | 7/1956 | Levy | 179/115.5 BS |
| 2,775,653 | 12/1956 | Wurdel | 179/115.5 VC |
| 2,926,221 | 2/1960 | Kagdis | 179/115.5 DV |
| 3,055,991 | 9/1962 | Guss | 179/115.5 DV |
| 3,239,029 | 3/1966 | Namon | 181/157 |
| 3,250,862 | 5/1966 | Rollins | 179/115.5 R |
| 3,350,514 | 10/1967 | Cooke | 179/115.5 R |
| 3,424,873 | 1/1969 | Walsh | 179/115.5 R |
| 3,649,776 | 3/1972 | Burton | 179/115.5 R |
| 4,315,112 | 2/1982 | Hofer | 179/115.5 R |
| 4,317,965 | 3/1982 | Toyoda | 179/115.5 R |
| 4,320,263 | 3/1982 | Thiele | 179/115.5 VC |
| 4,341,930 | 7/1982 | Steinle et al. | 179/115.5 R |
| 4,451,928 | 5/1984 | Murayama | 179/115.5 PS |

FOREIGN PATENT DOCUMENTS

| | | |
|---|---|---|
| 1094304 | 12/1960 | Fed. Rep. of Germany . |
| 2756301 | 6/1978 | Fed. Rep. of Germany . |
| 750045 | 9/1934 | France . |
| 365856 | 9/1938 | Italy . |
| 5546653 | 9/1978 | Japan . |
| 560219 | 3/1944 | United Kingdom . |

*Primary Examiner*—Gene Z. Rubinson
*Assistant Examiner*—Danita R. Byrd

[57] ABSTRACT

An improved multidriver loudspeaker includes a low frequency driver having an elongated voice coil former terminating in an inverted speaker cone and a high frequency driver located along the voice coil former. The voice coil former is formed such that the virtual or apparent acoustical source of the low frequency driver is substantially coincident with the virtual or apparent acoustical source of the high frequency driver. The virtual or apparent acoustical source of a driver being the point in space where the sound wave front from the driver appears to a listener to originate at the time that input is applied to the driver.

8 Claims, 4 Drawing Figures

MULTIDRIVER LOUDSPEAKER

BACKGROUND OF THE INVENTION

The invention relates generally to loudspeakers and particularly to an improved multidriver loudspeaker.

Ideally, a loudspeaker-driver should be capable of reproducing all frequencies so that the source of, for example, the high and low frequency sound waves is a single location. This would result in the time and phase coherence of all sound waves, thereby producing undistorted natural sound. It is difficult, however, to build a conventional driver that is both big enough to reproduce the low frequencies and light enough to reproduce the high frequencies. Therefore, most loudspeaker systems utilize two or more drivers and are termed multidriver loudspeaker. Several major problems arise when multiple drivers are used in a single loudspeaker. Specifically, at some frequencies several drivers are functioning and the actual location of the sound is not fixed for the listener. In addition, as the listener moves around the listening area, the distance from each driver to the listener changes in a non-uniform manner, such that at one location the listener is closer to the low frequency driver and at a second location the listener is closer to the high frequency driver. This results in the non-synchronization of the wave fronts reaching the listener at all frequencies. Finally, at the crossover point, where both drivers are producing the same amount of output, phase shifts will exist between the sound waves emanating from the two drivers caused by the difference in path lengths from the drivers to the listener. To a great extent, these problems are inherent in any multidriver loudspeaker system and are caused by the fact that the apparent or virtual acoustical source of the drivers are not all at the same location. The apparent or virtual acoustical source of a driver is the point in space where the sound wave front from the driver appears to a listener to originate at the time the input is applied to the driver. Typically, in view of the inertial characteristics of the driver, the apparent acoustical source of a driver is behind the voice coil—cone junction and within the magnetic structure of the driver.

Obviously, if the apparent acoustical source for all of the drivers were the same point in space many of the problems described above would be solved. In fact, several complex mechanical structures have been developed in an attempt to achieve this, resulting in the embedding of the high frequency driver inside the magnetic structure of the low frequency driver. Practically, these speakers are too expensive to manufacture and as such, are not manufactured. Further, even if speakers of this type could be manufactured at a reasonable cost, they incorporate other disadvantages since the sides of a low frequency driver tend to act somewhat like a horn with respect to the sound emanating from the low frequency driver (horn loading) thereby distorting the sound produced thereby.

Ohter attempts to solve the problems inherent in multidriver loudspeakers include positioning the high frequency driver in front of the low frequency driver. This solution is unsatisfactory as it creates a constant time delay in the sound waves emanating from the low frequency driver which becomes acute at the crossover of the two drivers. Further, the high frequency driver in such an arrangement serves as a diffracting object and interferes with the second produced by the low frequency driver.

SUMMARY OF THE INVENTION

It is therefore an object of the present invention to provide an improved multidriver loudspeaker which overcomes the problems inherent in multidriver loudspeaker of the prior art.

Another object of the present invention is to provide an improved multidriver loudspeaker in which the apparent acoustical source of both the high and low frequency drivers appear to a listener to be at a single location.

Still another object of the present invention is to provide an improved multidriver loudspeaker in which the wave fronts from the high and low frequency drivers are synchronized with respect to time, phase and response.

A further object of the present invention is to provide an improved multidriver loudspeaker which is simple in construction and inexpensive to manufacture.

In accordance with the present invention an improved multidriver loudspeaker includes a low frequency driver having an elongated voice coil former terminating in an inverted speaker cone and a high frequency driver located along the voice coil former. The voice coil former is formed such that the apparent acoustical source of the low frequency driver is substantially coincident with the apparent acoustical source of the high frequency driver.

BRIEF DESCRIPTION OF THE DRAWINGS

The above brief description as well as further objects, features and advantages of the present invention will be more fully understood by reference to the following detailed description of the presently preferred but nonetheless illustrative embodiments in accordance with the present invention, when taken in conjunction with the accompanying drawing, wherein.

DESCRIPTION OF THE PREFERRED EMBODIMENTS

Figure 2:
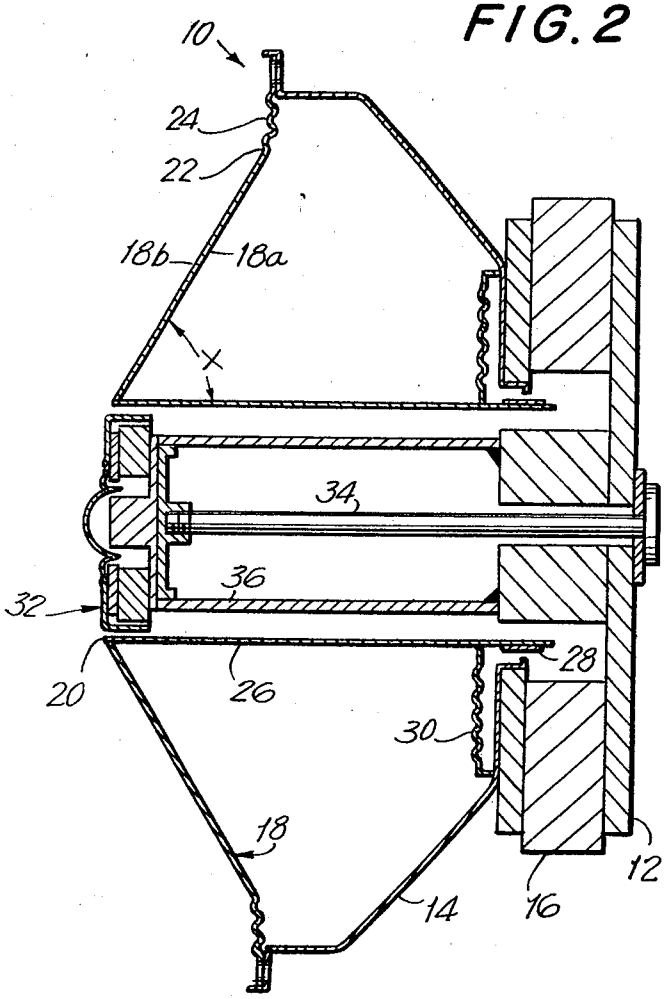
FIG. 2 is a right side elevational sectional view of the multidriver loudspeaker taken substantially along the line 2—2 of FIG. 1 and looking in the direction of the arrows.
Figure 1:
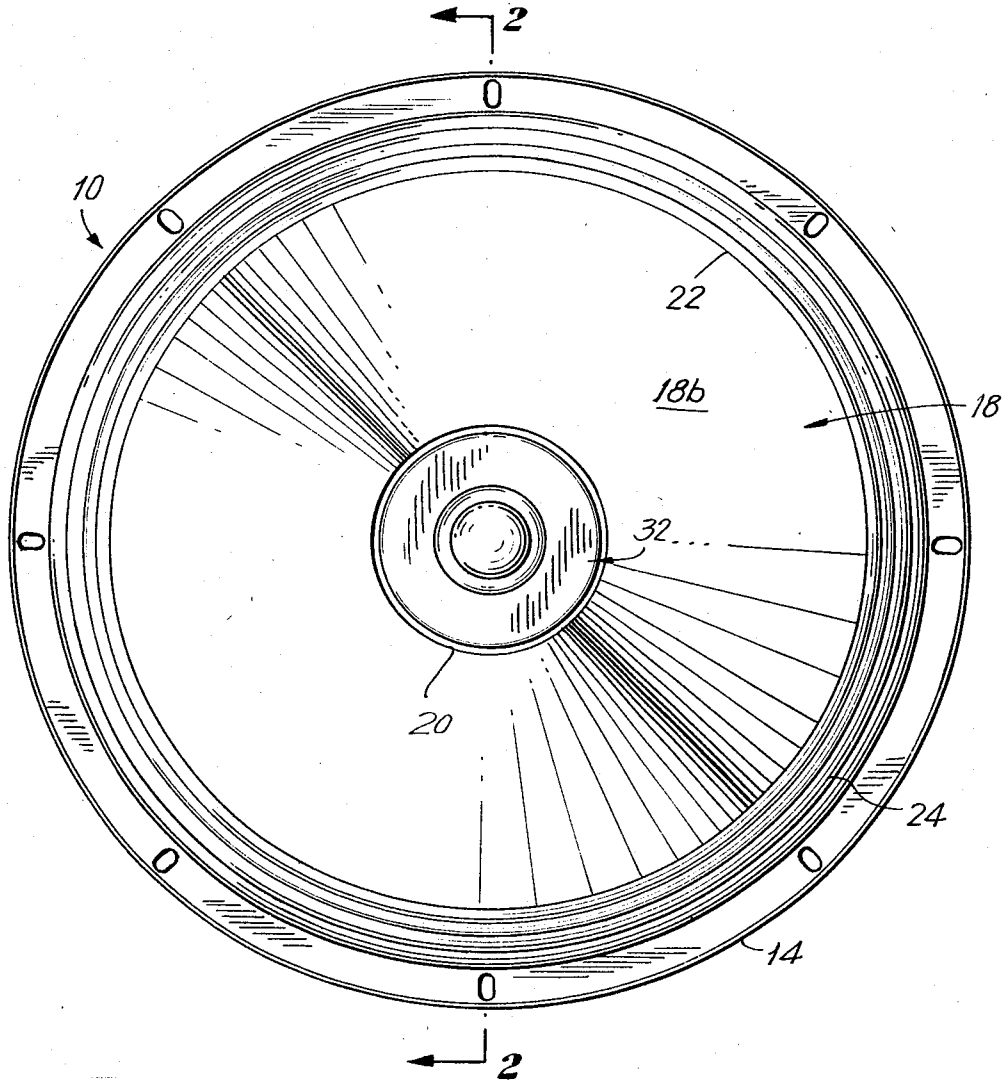
FIG. 1 is a front elevational view of the multidriver loudspeaker of the present invention.

Referring first to FIGS. 1 and 2 a multidriver loudspeaker, indicated generally by the reference numeral 10, includes both a high frequency driver and a low frequency driver and is formed from a base 12 adapted to support a steel basket enclosure 14 and a magnet assembly 16 for the low frequency driver. Disposed within the basket 14 is an inverted conical diaphragm or cone 18 which is a thin, curved sheet, the surface of which is of a shape such as would be generated by the rotation of a straight or, alternatively, a curved line about an axis. Such a surface, generated by a curved line, is not a true cone, but is generally referred to as such in the industry and is included within the term "cone" as used herein. The cone 18 may be made of a stiff material, such as felted fiber, paper, a felted fiber and paper composition, or plastic.

The cone 18 is associated with the low frequency driver and includes an inner concave sound radiating surface 18*a* and an outer convex sound radiating surface 18*b*. The cone 18 also includes two coaxial ends; the upper, smaller end of the cone 18 is referred to as the driving circle 20 and the larger end of the cone 18 is referred to as the surround 22. The angle X of the cone 18 refers to the angle formed between a line perpendicular to the base 12 and the inner surface 18*a* at the surround 22. The angle X in this particular embodiment approximates 60 degrees. A damping ring 24 secures the surround 22 of cone 18 to the basket 14. The driving circle 20 is secured to one end of an elongated voice coil former 26, the opposite end of which is centered in the annular gap between the pole pieces of the magnet assembly 16 and includes a voice coil 28. A damping ring 30 secures the end of the voice coil former 26 proximate to the voice coil 28, to the basket 14. The damping rings 24 and 30 serve to center the voice coil former 26 and the cone 18 within the basket 14 but permit the cone and former freedom to move axially.

The voice coil 28 is glued to the former 26 and positioned in the air gap of the magnet assembly 14, which together with coil 28 forms a conventional loudspeaker motor. Varying currents proportional to audio frequencies generated by a sound source such as a record or tape are suitably amplified and are applied to conventional input terminals (not shown) of the voice coil 28 which then interracts with the magnetic field in the gap to cause the coil to undergo mechanical longitudinal translational movements at a rate which is proportional to the audio frequencies. When the voice coil 28 undergoes its longitudinal translational motion, that motion is imparted through the former 26 to the cone 18 and audible sound (in the low frequency range) is produced in the air.

A conventional high frequency driver 32 is located within the former 26 at the end proximate to the driving circle 20 and is supported by a pin 34 and a housing 36 extending along the length of the former 26. As such, the high frequency driver is coaxial with the low frequency driver.

The multidriver loudspeaker described thus far shows the coaxial arrangement of both the low frequency and high frequency drivers. However, in this arrangement, the apparent acoustical source of the low frequency driver is not the same as the apparent acoustical source of the high frequency driver. Specifically, the apparent acoustical sources of both the high frequency driver and low frequency driver are located just in front of their respective manget assemblies. Different apparent acoustical sources for the low frequency and high frequency drivers creates a time delay distortion in which the reproduced sounds are vaguely unnatural. This distortion is due to the fact that the reproduced sounds from the high frequency driver and the low frequency driver do not simultaneously arrive at the listener's ear.

The instant invention minimizes this problem by moving the apparent acoustical source of the low frequency driver to a point substantially coincident with the location of the apparent acoustical source of the high frequency driver. This is accomplished by manipulating the time delay of the low frequency driver in a manner to be more fully described hereinbelow.

Specifically, the cone 18 will move similarly to the voice coil 28 but delayed by the time it takes for the sound to travel the length of the voice coil former 26. This time delay is represented by the following equation:

$$\text{Time Delay} = \frac{\text{Length of Former}}{\text{Speed of sound in Former as a multiple of the speed of Sound in Air}}$$

Typically, drivers are formed with as short a voice coil former as possible so as to minimize this time delay. However, the creation of an appropriate time delay serves to locate the apparent acoustical source of the low frequency driver along the voice coil former 26 as opposed to locating it in the magnet assembly as done in the prior art. Placing the high frequency driver 32 within the former 26 and creating a time delay which moves the apparent acoustical source of the low frequency driver to approximately the same location as the high frequency driver 32 results in the in-phase output of both the high and low frequency drivers. As such, both drivers, while not at the same physical location, are perceived to have the same apparent acoustical source in view of the synchronized wave fronts emanating from both the low and high frequency drivers. The appropriate time delay may be accomplished by extending the length of the voice coil former 26, which is made of a material which transmits sound at a speed greater than the speed of sound in air. For example, if the former is 5 inches long and has a speed of sound transmission ten times that of air, the acoustical apparent length of the former would only be 0.5 inches. By placing the high frequency driver 0.5 inches into the end of the former 26, proximate to the driving circle 20, the apparent acoustical source of both the high and low frequency drivers would be at approximately the same location. The specific length of the voice coil former 26 and the material chosen for its construction may be varied to suit the particular application. For example, voice coil formers made from metal instead of paper are contemplated. Specifically, a longer former will result in a longer time delay while a shorter former will usually result in a shorter time delay, with the increasing speed of sound transmission of the material serving to shorten the time delay.

It is not necessary to achieve the exact coincidence of the apparent acoustical sources of the two drivers. A listener hearing two sources of sound that are within one-sixth of a wavelength of each other will not be able to perceive the two sources separately and instead perceives the sound waves coming from the two sources as if they were coming from a single source. As such, it is only necessary to position the two apparent acoustical sources such that the sound waves emanating therefrom are within one-sixth of a wavelength of each other. The listener will perceive the two sources as being only one.

Figure 4:
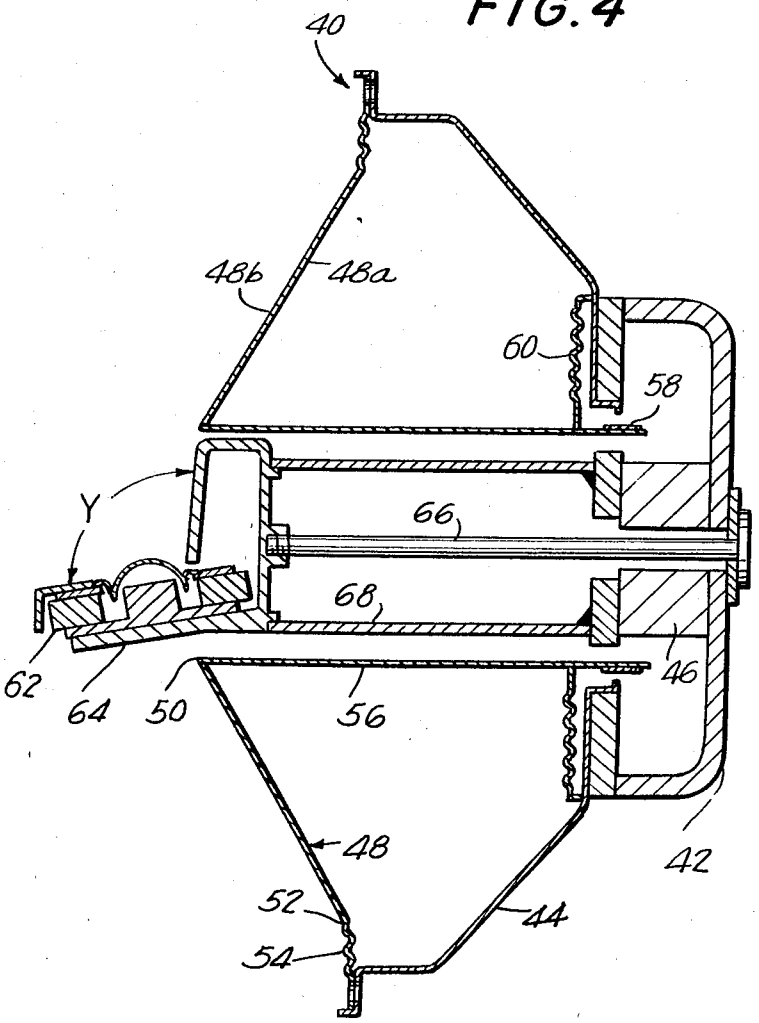
FIG. 4 is a right side elevational sectional view of the multidriver loudspeaker taken substantially along the line 4—4 of FIG. 3 and looking in the direction of the arrows.
Figure 3:
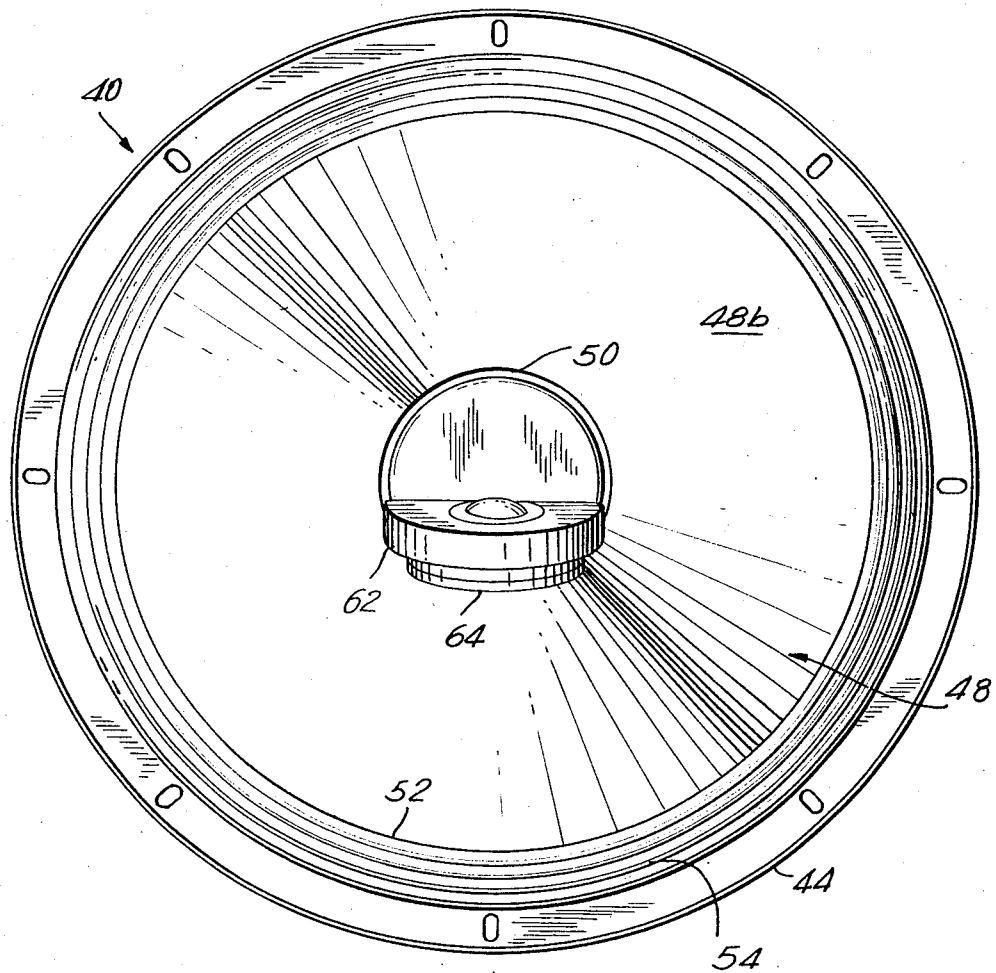
FIG. 3 is a front elevational view of an alternate embodiment of the multidriver loudspeaker of the present invention.

Referring now to FIGS. 3 and 4 an alternate embodiment of the multidriver loudspeaker of the present invention is indicated generally by the reference numeral 40 and includes both a high frequency driver and a low frequency driver. A base 42 is adapted to support a steel basket enclosure 44 and a magnet assembly 46 for the low frequency speaker.

Disposed within the basket 44 is an inverted conical diaphragm or cone 48 which is associated with the low frequency driver and includes an inner concave sound radiating surface 48*a* and an outer convex sound radiating surface 48*b*. The cone 48 also includes two coaxial ends; the upper, smaller end of the cone 48 is referred to as the driving circle 50 and the larger end of the cone 48 is referred to as the surround 52. A damping ring 54 secures the surround 52 of cone 48 to the basket 44. The driving circle 50 is secured to one end of an elongated voice coil former 26, the opposite end of which is centered in the annular gap between the pole pieces of the magnet assembly 46 and includes a voice coil 58. A damping ring 60 secures the end of the voice coil former 54 proximate to the voice coil 28 to the basket 44. The damping rings 54 and 60 serve to center the voice coil former 56 and the cone 48 within the basket 44 but permit the cone and former to move axially.

The voice coil 58 is glued or otherwise permanently affixed to the former 56 and positioned in the air gap of the magnet assembly 44, which together with coil 58 forms a conventional loudspeaker motor for the low frequency driver.

A conventional high frequency driver 62 is located along and partially within the former 56 at the end proximate to the driving circle 50. High frequency driver 62 is secured to an L-shaped mounting bracket 64 which is supported by a pin 66 and a housing 68 extending along the length of the former 56. The high frequency driver 62 is canted with respect to a plane perpendicular to the axis of the low frequency driver and formed at the driving circle 20, at an angle Y. The angle Y in this particular embodiment approximates 105 degrees.

The voice coil former 56 is formulated in accordance with the principles outlined above to create an appropriate time delay in low frequency driver by moving the apparent acoustical source of the low frequency driver out of the magnet assembly 46 and forward along the voice coil former 56 to approximately the same location as the apparent acoustical source of the high frequency driver 62. In this particular embodiment the voice coil former is constructed so as to move the apparent acoustical source of the low frequency driver as close as possible to the end of the voice coil former 56 proximate the driving circle 50. At this location, the sound waves emanating from the low and high frequency drivers are within one sixth of a wavelength of each other, and a listener will perceive the two sources as being only one.

This embodiment is particularly adapted for use as an automobile loudspeaker. The use of the canted high frequency driver 62 is well suited for the placement locations available for loudspeakers in automobiles. Typically, these locations include the package shelf (situated behind the rear seats), the dash board and the lower portions of the car doors. The limited number of possible loudspeaker locations coupled with the fact that the position of the listeners in automobiles is generally stationary with respect to the loudspeakers, permits the use of the canted high frequency driver 62 arrangement to direct the sound emanating from this smaller, lower power driver directly at the listeners. As a result, the sound emanating from the high frequency driver 62 is not directed against the rear window, windshield or into the footwells of the automobile. This is accomplished without the problems normally encountered when the high frequency driver is placed in front of the low frequency driver in a multidriver loudspeaker. Further, the listeners will perceive the separate sound waves emanating from the high and low frequency drivers as originating from a single location.

As will be readily apparent to those skilled in the art, the invention may be used in other specific forms or for other purposes without departing from its spirit or central characteristics. The present embodiment is therefore to be considered as illustrative and not restrictive, the scope of the invention being indicated by the claims rather than by the foregoing description, and all embodiments which come within the range of equivalence of the claims are intended to be embraced.

I claim:

1. A multidriver loudspeaker comprising a low frequency driver having an inverted speaker cone, and an elongated voice coil former secured at one end to said inverted speaker cone, said low frequency driver having a virtual acoustical source which is the perceived origin of the sound emanating from the driver, said virtual acoustical source of said low frequency driver located along the voice coil former at a point proximate to the junction of said voice coil former and said inverted speaker cone, a high frequency driver having a virtual acoustical source, said high frequency driver located inside the voice coil former at a point proximate to the junction of said voice coil former and said inverted speaker cone so that the virtual acoustical source of said high frequency driver is at approximately the same location as the virtual acoustical source of said low frequency driver.

2. A multidriver loudspeaker comprising a low frequency driver having an inverted speaker cone, and an elongated voice coil former secured at one end to said inverted speaker cone, said low frequency driver having a virtual acoustical source which is the perceived origin of the sound emanating from the driver, said virtual acoustical source located along the voice coil former at a point determined by the length of the voice coil former and the material from which it is made, a high frequency driver having a virtual acoustical source, said high frequency driver located inside the voice coil former so that the virtual acoustical source of said high frequency driver is at approximately the same location as the virtual acoustical source of said low frequency driver.

3. A multidriver loudspeaker comprising a base, a magnet assembly secured to said base, a voice coil positioned in communication with said magnet assembly, an elongated voice coil former adapted at one end to support said voice coil, an inverted speaker cone secured to the opposite end of said voice coil former, said manget assembly, voice coil, voice coil former and speaker cone forming a low frequency driver, said low frequency driver having a virtual acoustical source which is the perceived origin of the sound emanating from said low frequency driver, said virtual acoustical source of said low frequency driver located at a point along said voice coil former remote from said magnet assembly, a high frequency driver having a virtual acoustical source, means extending from said base of said low frequency driver and secured to said high frequency driver for locating said high frequency driver at a point inside said voice coil former such that the virtual acoustical source of said high frequency driver is at approximately the same location as the virtual acoustical source of said low frequency driver.

4. A multidriver loudspeaker as in claim 3 in which the location of the virtual acoustical source of the low frequency driver at a point along said voice coil former remote from said magnet assembly is achieved by so choosing the length of the voice coil former and the material from which the voice coil former is made.

5. A multidriver loudspeaker comprising a base, a magnet assembly secured to said base, a voice coil positioned in communication with said magnet assembly, an elongated voice coil former adapted at one end to support said voice coil, an inverted speaker cone secured to the opposite end of said voice coil former, said magnet assembly, voice coil, voice coil former and speaker cone forming a low frequency driver, said low frequency driver having a virtual acoustical source which is the perceived origin of the sound emanating from said low frequency driver, said virtual acoustical source of said low frequency driver located along said voice coil former at a point proximate to the junction of said voice coil former and said inverted speaker cone, a high frequency driver having a virtual acoustical source, means including said base for locating said high frequency driver at a point proximate to the junction of said voice coil former and said inverted speaker cone such that the virtual acoustical source of said high frequency driver is at approximately the same location as the virtual acoustical source of said low frequency driver.

6. A multidriver loudspeaker as in claim 3 in which the location of the virtual acoustical source of the low frequency driver at a point along said voice coil former proximate to the junction of said voice coil former and said inverted speaker cone is achieved by choosing the length of the voice coil former and the material from which the voice coil former is made.

7. A multidriver loudspeaker as in claim 6 in which said high frequency driver extends partially outwardly from said voice coil former.

8. A multidriver loudspeaker as in claim 7 in which said high frequency driver is canted with respect to a plane perpendicular to the axis of the low frequency driver and formed at the end of the voice coil former secured to said low frequency driver.

* * * * *